United States Patent [19]

Goodwin

[11] 4,073,518

[45] Feb. 14, 1978

[54] ELECTRICALLY AND MANUALLY ACTUATABLE DOOR LOCKING STRUCTURE

[76] Inventor: Charles M. Goodwin, Rte. No. 2, Mount Vernon, Ohio 43050

[21] Appl. No.: 691,144

[22] Filed: May 28, 1976

[51] Int. Cl.[2] ..... E05B 47/06

[52] U.S. Cl. ..... 292/144; 70/107; 70/152; 70/222; 70/279; 292/143

[58] Field of Search ..... 70/107, 283, 218, 207, 70/149, 279, 222, 152; 292/144, 153, 356, 348, 143; 307/66

[56] References Cited

U.S. PATENT DOCUMENTS

| | | | |
|---|---|---|---|
| 503,202 | 8/1893 | Doebler | 292/348 |
| 504,482 | 9/1893 | Swanson | 70/107 |
| 642,413 | 1/1900 | Armstrong et al. | 70/107 |
| 1,919,750 | 7/1933 | Rymer | 70/149 |
| 1,940,018 | 12/1933 | Rymer | 70/149 |
| 2,103,702 | 12/1937 | Tibbetts | 70/283 |
| 2,291,402 | 7/1942 | Miller | 292/144 X |
| 2,299,646 | 10/1942 | Muller | 70/283 |
| 3,621,685 | 11/1971 | Sargent | 70/107 |
| 3,792,888 | 2/1974 | Kambic | 292/144 X |
| 3,816,752 | 6/1974 | Goodwin | 307/66 |
| 3,881,331 | 5/1975 | Tranberg et al. | 70/107 |
| 3,907,343 | 9/1975 | Goodwin | 292/144 |

FOREIGN PATENT DOCUMENTS

| | | | |
|---|---|---|---|
| 619,881 | 4/1927 | France | 70/107 |
| 331,740 | 7/1930 | United Kingdom | 292/153 |

*Primary Examiner*—Roy D. Frazier
*Assistant Examiner*—Rodney H. Bonck
*Attorney, Agent, or Firm*—Clarence A. O'Brien; Harvey B. Jacobson

[57] ABSTRACT

A lock housing is provided for mounting upon or in a door, but which may also be mounted upon or in a door frame. Latch and bolt bars disposed in side-by-side relation are supported from the housing for lengthwise extension and retraction relative thereto. A locking pawl is mounted on a shaft oscillatably supported in the housing and extending transversely of the inner ends of the latch and bolt bars and the pawl is swingable into and out of position behind the inner ends of the bars when the latter are in their extended positions. A first pair of solenoids are selectively operative on 12 volt D.C. and 110 or 12 volt A. C. current to shift the shaft to a position with the pawl in an unlocked position and the third solenoid is operative to shift the shaft to a position with the locking pawl in the locked position. Further, a doorknob construction is rotatably received through the housing and includes an operator mounted thereon for rotation therewith by means of a slip clutch for manually shifting the bolt and latch bars between their locked and unlocked positions, the latch bar being spring-biased toward its locked position.

7 Claims, 11 Drawing Figures

ELECTRICALLY AND MANUALLY ACTUATABLE DOOR LOCKING STRUCTURE

BACKGROUND OF THE INVENTION

The need for reliable door locking systems for use in businesses and residence homes is becoming increasingly apparent. Further, the trend toward electronically actuated locks is also increasing due to the convenience of opening a lock without the utilization of a key and the ability of an electrically actuated lock to be rendered more completely tamper-proof.

While numerous different structures have been heretofore designed in attempts to provide more reliable and more tamper-proof locks, many of these previous attempts have either failed to achieve the total objectives or have resulted in extremely complicated and expensive locking units.

Examples of previously patented door locking systems of the electrically actuated type are disclosed in U.S. Pat. Nos. 698,812, 3,408,838, 3,529,454, 3,625,933, 3,641,396 and 3,774,422.

BRIEF DESCRIPTION OF THE INVENTION

The lock of the instant invention includes an electrically actuatable first locking and unlocking structure which may be manually actuated from one side of the locking structure and a second locking structure of the key type for overriding a conventional doorknob-type latch and bolt operator. The key operated lock is operative to prevent the doorknob actuated operator from shifting toward the unlocked position and a doorknob structure is provided including a lock and latch bolt retracting operator driven through a slip clutch and thereby rendering any attempts to apply excessive torque to the doorknob structure ineffective to unlock the lock and latch bolts of the lock structure.

The main object of this invention is to provide a dependable door locking structure which will be substantially tamper-proof.

Another object of this invention is to provide a dependable door locking structure which may be mounted either upon the associated door or in an associated doorjamb.

Another object of this invention is to provide a door locking structure which may be locked and unlocked both manually and electrically.

Still another object of this invention is to provide a door locking structure including an overriding key operated lock.

A final object of this invention to be specifically enumerated herein is to provide a door locking structure in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
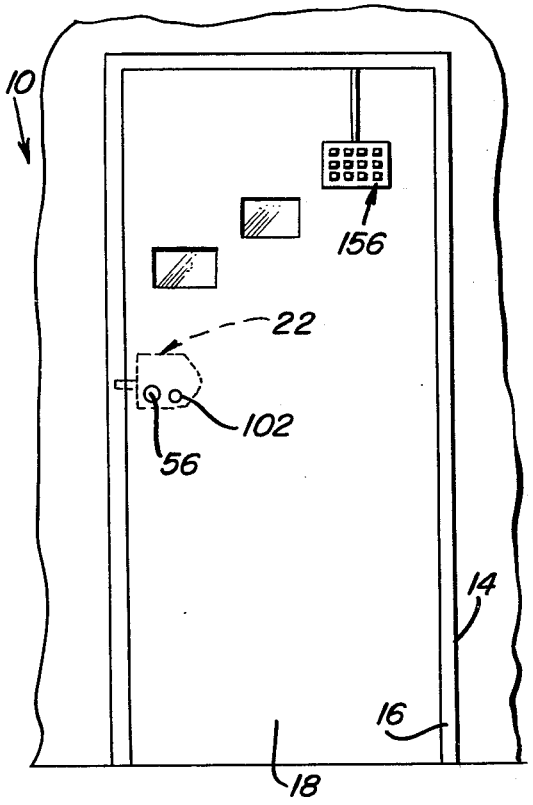
FIG. 1 is an elevational view of the exterior of a door equipped with the locking structure of the instant invention.

Referring now more specifically to the drawings, the numeral 10 generally designates a wall having a door opening 14 formed therein defined by a door frame 16. A door 18 is pivotally mounted from the frame 16 by means of suitable hinges 20 for swinging of the door 18 between open and closed positions relative to the frame 16.

The door locking structure of the instant invention is referred to in general by the reference numeral 22 and includes lock and latch bolts 24 and 26. The structure 22 includes a housing referred to in general by the reference numeral 28 and the housing includes an open side 30 which is removably closed by a cover plate 32 secured in position by means of suitable fasteners 34. In addition, the housing 28 includes one wall 36 through which the bolts 24 and 26 are protractable and retractable.

Figure 4:
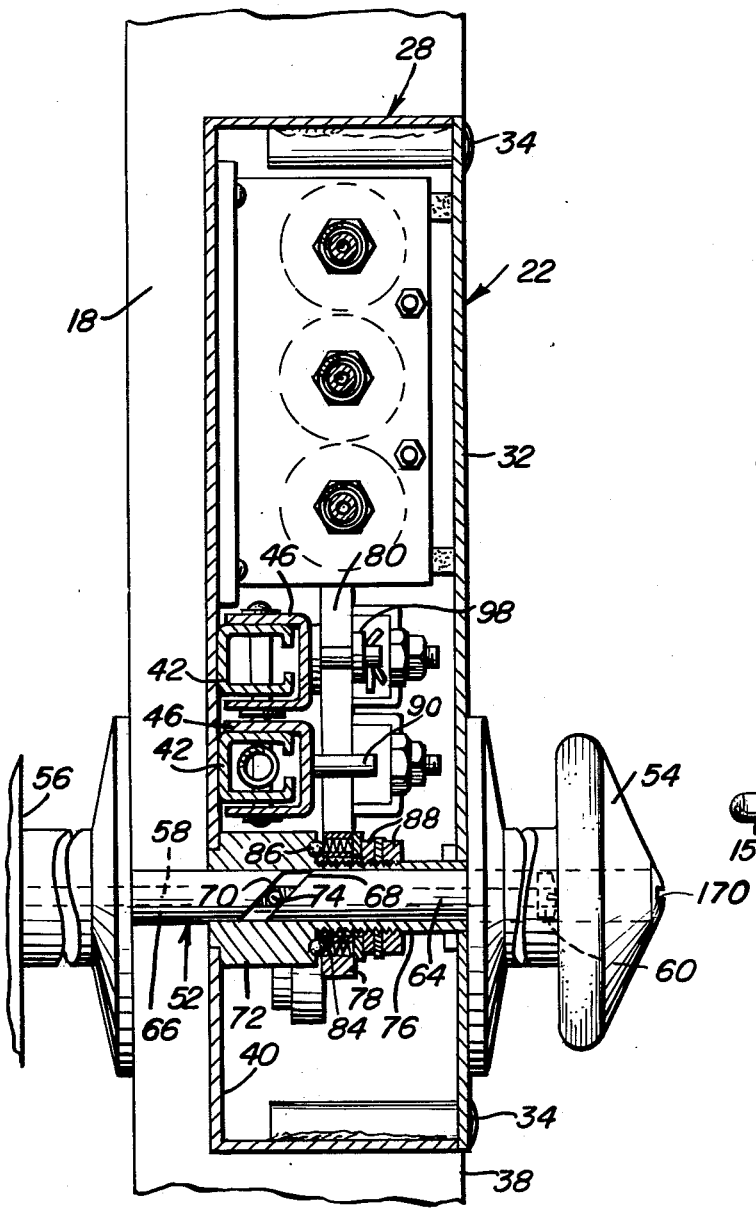
FIG. 4 is an enlarged fragmentary vertical sectional view taken substantially upon the plane indicated by the section line 4—4 of FIG. 3.
Figure 5:
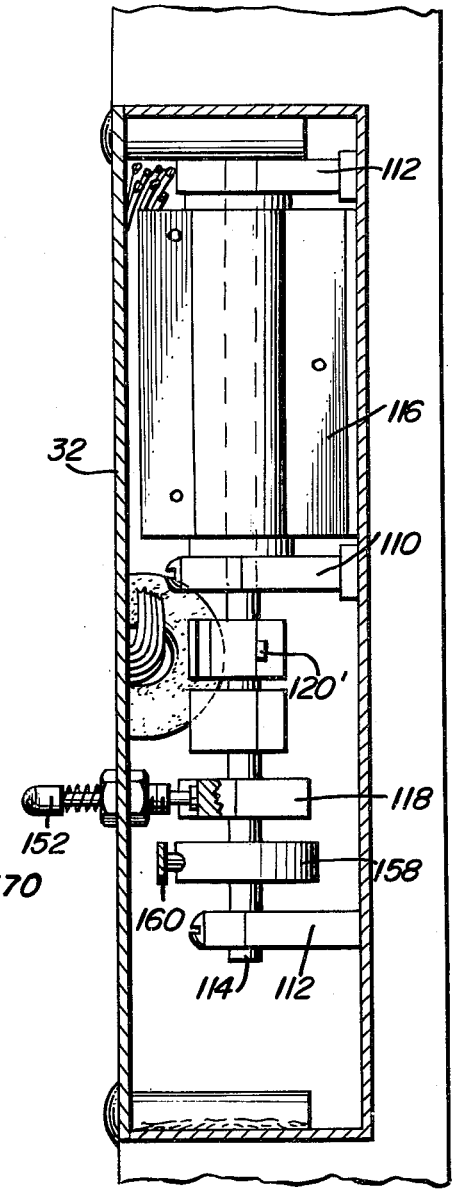
FIG. 5 is an enlarged vertical fragmentary sectional view taken substantially upon the plane indicated by the section line 5—5 of FIG. 3.
Figure 10:
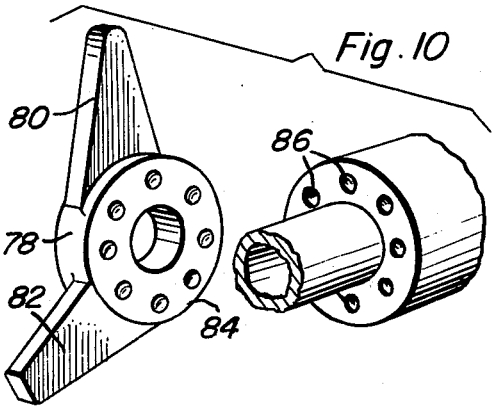
FIG. 10 is a fragmentary exploded perspective view of the slip clutch portion of the doorknob actuated latching and unlatching structure.

As may best be seen from FIGS. 4 and 5 of the drawings, the housing 28 is recessed within the inner side 38 of the door 18. Further, the housing 28 includes an inner wall 40 remote from the cover or cover plate 32. The inner wall 40 has a pair of guide and support bars 42 mounted on its inner surface by means of suitable fasteners 44 and a pair of inverted channel-shaped followers 46 are mounted on the bars 42 for limited shifting therealong. The opposite side flanges of the followers 46 have longitudinal slots 48 formed therein and the slots 48 slidingly receive the opposite end portions of movement limiting shafts 50 secured through the bars 42 and the opposite side flanges of the followers 46.

Figure 3:
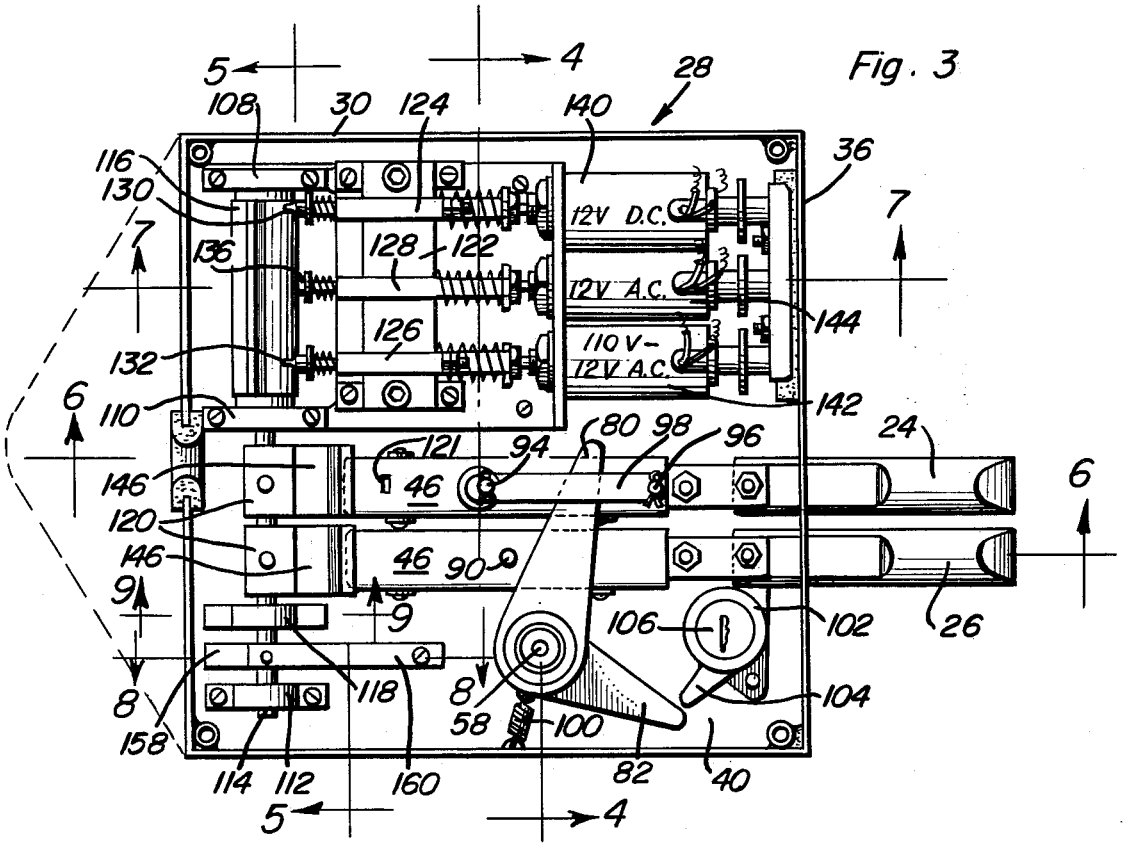
FIG. 3 is an elevational view of the door locking structure on somewhat of an enlarged scale and with the inside cover thereof removed.

With attention now invited more specifically to FIG. 3, it may be seen that the lower latch bolt 26 is supported from one end of the lower follower 46 and that the upper lock bolt 24 is supported from the end of the upper follower 46. The lower follower 46 is spring-biased toward a position which the latch bolt 26 in the extended latched position relative to the wall 36 and the follower 46 from which the upper lock bolt is supported is merely lightly frictionally retained in any position in which it is placed by frictional contact between that follower 46 and the associated bar 42.

A doorknob assembly referred to in general by the reference numeral 52 is journaled through the housing 28 and the portion of the door disposed to the exterior of the housing 28. The assembly 52 includes inner and outer knobs 54 and 56 secured together by a through screw 58 having its head 60 recessed in the inner knob 54. The knobs 54 and 56 include inwardly projecting tubular extensions 64 and 66 through which the screw 58 extends and the extensions 64 and 66 include parallel beveled adjacent end faces 68 and 70. The adjacent ends of the tubular extensions 64 and 66 are enclosed within a sleeve 72 journaled from the wall 40 of the housing 28 and the sleeve 72 includes inwardly projecting diametrically opposite pins 74 captive between the end faces 68 and 70. The sleeve 72 includes a diametrically reduced end 76 which extends toward and is rotatably received through the cover 32 and a bell crank 78 including a pair of abutment arms 80 and 82 is rotatable on the diametrically reduced end 76 and carries a plurality of circumferentially spaced spring-biased ball detents 84 which are seatable in opposing circumferentially spaced partial spherical recesses 86 formed in the opposing end of the larger diameter portion of the sleeve 72. The bell crank 78 is held in position on the diametrically reduced end 76 of the sleeve 72 by means of jamnuts 88 threadedly engaged on the diametrically reduced end portion 76.

The lower follower 46 includes an outstanding pin 90 engageable by the arm 80 to shift the lower follower 46 to a position with the latch bolt 26 in a retracted position, the lower follower 46 being spring-biased toward a position with the latch bolt 26 in the extended position by means of a compression spring 92, and the upper follower 46 includes a pair of outstanding pins 94 and 96 between which the free end of the arm 80 is received and interconnected by means of a strap 98 having its opposite ends secured over the free ends of the pins 94 and 96, the mid-portion of the strap 98 passing over the free end portion of the arm 80. The bell crank 78 is spring-biased to an intermediate position by means of an expansion spring 100, see FIG. 3, and may be rotated in a clockwise direction from the position thereof illustrated in FIG. 3 to urge the upper follower 46 to a position with the lock bolt 24 extended and allowing the lower follower 46 to be spring-biased to a position with the lower latch bolt 26 in the extended position. In addition, the bell crank 78 may be rotated in a counterclockwise direction from the position thereof illustrated in FIG. 3 so as to engage the arm 80 with the pins 90 and 94 and shift the followers 46 to positions with the bolts 24 and 26 in the retracted positions.

A conventional key operated lock structure 102 is supported from the wall 40 and includes an abutment arm 104 shiftable into and out of position for engagement with the arm 82 of the bell crank 78 to prevent counterclockwise rotation of the bell crank 78 from the position thereof illustrated in FIG. 3 when the abutment 104 is engaged with the arm 82. Of course, the key receiving barrel 106 of the lock structure 102 is received through the cover 32 of the lock structure 22.

Three journal blocks 108, 110 and 112 are supported from the wall 40 of the housing 28 and oscillatably support an operating shaft 114, see FIG. 3. The shaft 114 has a first long cam 116 mounted thereon as well as a second shorter cam 118 mounted thereon. In addition, an intermediate portion of the shaft 114 has a pair of locking dogs or pawls 120 mounted thereon.

Figure 6:
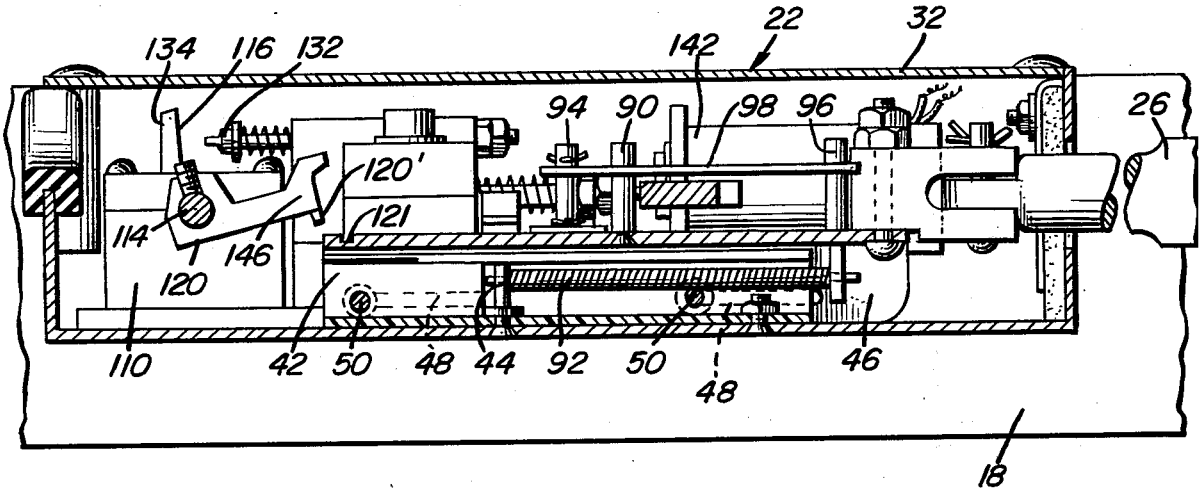
FIG. 6 is a horizontal sectional view on somewhat of an enlarged scale taken substantially upon the plane indicated by the section line 6—6 of FIG. 3.
Figure 7:
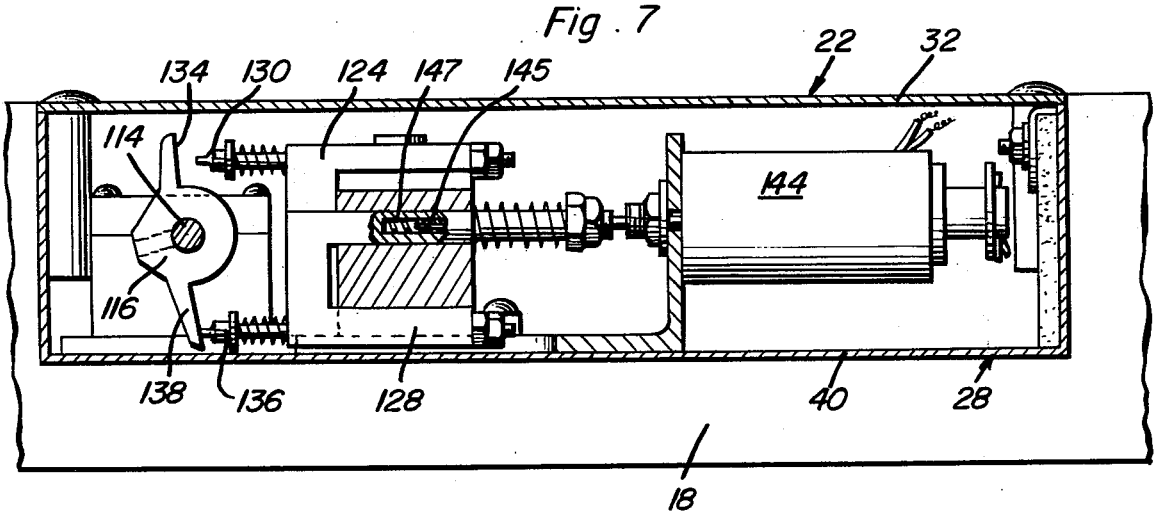
FIG. 7 is an enlarged fragmentary horizontal sectional view taken substantially upon the plane indicated by the section line 7—7 of FIG. 3.

A support and guide block 122 is also mounted on the wall 40 and has a first pair of followers 124 and 126 supported therefrom for reciprocal movement as well as a third follower 128 supported therefrom for reciprocal movement. The followers 124 and 126 include portions 130 and 132 which are engageable with one arm portion 134 of the cam 116, see FIG. 7, and the follower 128 includes a portion 136 engageable with a second arm 138 carried by the cam 116. 12 volt and 110 volt or 12 volt A. C. solenoids 140 and 142 are supported within the housing 28 for actuation of the followers 124 and 126 to shift the latter to the left as viewed in FIGS. 3 and 7 of the drawings and the followers 124 and 126 are spring-biased to the right. A third solenoid 144 is also supported from the housing 28 and operatively associated with the follower 128 in order to shift the latter to the left and the follower 128 is also spring-biased to the right as viewed in FIGS. 3 and 7, the solenoids 140, 144 and 142 each including an armature shaft portion 145 engageable, through an impact cushioning member 147, with the corresponding follower 124, 126 and 128, see FIG. 7. Accordingly, it will be seen that actuation of either of the solenoids 140 and 142 will cause the cam 116 to be rotated in a counterclockwise direction as viewed in FIG. 7 of the drawings in order to swing the free end portions 146 of the pawls 120 in an upward direction to the positions thereof illustrated in FIG. 6 of the drawings out of registry with the rear ends of the followers 46 thereby enabling the lock and latch and bolts 24 and 26 to be shifted to the left as viewed in FIG. 3 of the drawings toward their retracted positions and the follower 46 for the lock bolt 24 includes a recess 121 in which a detent 120' of the corresponding pawl 120 is receivable when the bolt 24 is retracted so as to retain the bolt 24 in the retracted position against accidental extension. On the other hand, upon actuation of the solenoid 144 the portion 136 will engage the lower arm 138 of the cam 116 and cause the pawls to be turned in a clockwise direction as viewed in FIG. 6 of the drawings in order to swing the free end portions 146 of the pawls 120 into position behind the followers 46 thereby preventing movement of the lock and latch bolts 24 and 26 to their retracted positions. Still further, the cover 32 supports a pair of spring-biased push buttons 150 and 152 whose inner ends are engageable with opposite side portions of the cam 118. Accordingly, the shaft 114, and thus the pawls 120, may be oscillated by pushing alternate buttons 150 and 152 so as to shift the free end portions 146 of the pawls 120 into and out of lock and latch bolt locking position. However, the upper free end portion 146 in FIG. 3 is slightly lower than the lower free end portion in order that the detent 120' carried by the upper free end portion 146 may be seated in the recess 121 while the lower free end portion 146 in FIG. 3 is still elevated above the follower 46 for the latch bolt 26, thereby enabling longitudinal shifting of the latch bolt 26 while the lock bolt is retained in a retracted position.

Figure 2:
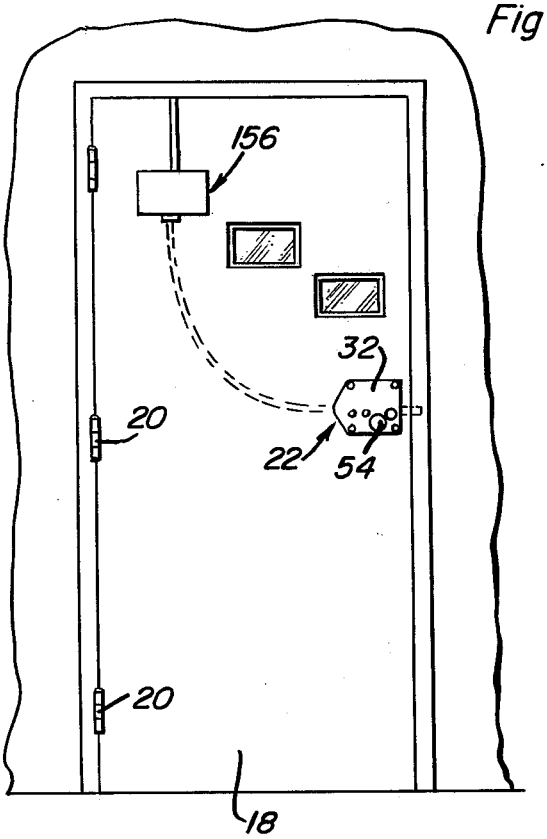
FIG. 2 is an elevational view of the interior side of the door illustrated in FIG. 1.

With attention now invited more specifically to FIGS. 1 and 2 of the drawings, there will be seen a push button control referred to in general by the reference numeral 156 for operating the solenoid 140, 142 and 144. This control is disclosed in my prior U.S. Pat. No.

Figure 8:
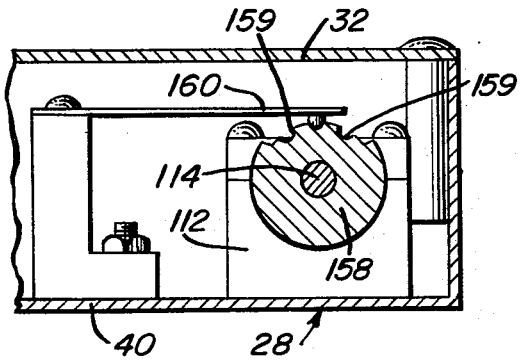
FIG. 8 is an enlarged fragmentary horizontal sectional view taken substantially upon the plane indicated by the section line 8—8 of FIG. 3.
Figure 9:
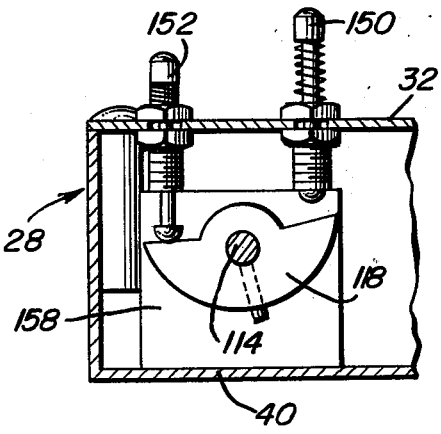
FIG. 9 is an enlarged fragmentary horizontal sectional view taken substantially upon the plane indicated by the section line 9—9 of FIG. 3.

3,816,752. Further, the shaft 114 has a detent disc 158 provided with recesses 159 mounted thereon, see FIGS. 3 and 8, with which a spring-type detent arm 160 is engaged in order to frictionally retain the shaft 114 in predetermined positions of oscillation.

Figure 11:
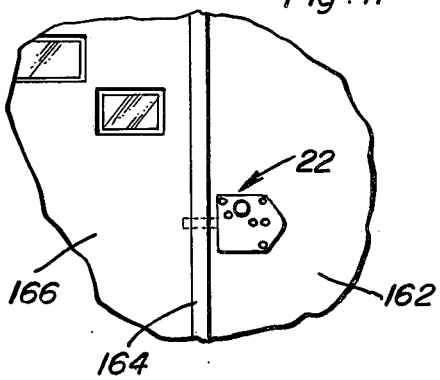
FIG. 11 is a fragmentary elevational view illustrating the manner in which the door locking structure may be mounted on a doorjamb and operatively associated with an associated door.

Also, from FIG. 11 it may be seen that the structure 22 may be supported from a wall 162 having a door opening 164 therein in which a door 166 is mounted for horizontal swinging movement between open and closed positions. In such an installation the bolts 24 and 26 will coact with keepers (not shown) in the free swinging edge of the door 166.

If the door locking structure 22 is to be wall mounted as illustrated in FIG. 11, the solenoid 142 may be actuatable by 110 volt A.C. in substantially all instances. However, if the structure is to be door mounted as illustrated in FIGS. 1 and 2, some local and state regulations may require that the solenoid be actuable by 12 volt A.C. Further, if 12 volt actuation of all three solenoids, 140, 142 and 144 is desired, all three may be operable by 12 volt D.C.

Further, the free end operation 146 from which detent 120' is supported is slightly lower than the other end portion 146 enabling detent 120' to be fully engaged in the recess 121 while a spacing remains between the other end portion 146 and latch bolt follower 46. Such spacing enables free movement of latch bolt 26 in either direction when the knobs 54 and 56 are turned or when slid by door action movements. With both pawls 120 in the fully applied positions when the bolts 24 and 26 are in their extended positions the need for free shifting of the latch bolt follower is not present because the door 18 will be bolted closed.

The inner knob 54 has a central cosmetic screw 170 threadedly engaged therein and engaged with the outer end of the head 60 of through screw 58 as a jamb member therefor.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A lock including a housing, a lock bar supported from said housing for longitudinal reciprocation between limit positions with one end extended and retracted relative to said housing, lock means shiftably supported from said housing for movement between locking and unlocking positions, said lock means and bar including coacting portions abuttingly engageable with each other to prevent shifting of said bar from said extended position toward said retracted position when said lock means is in said locking position, and operator means operative from the exterior of said housing for shifting said lock means between said locking position and said unlocking position, said operator means including a doorknob assembly journaled through said housing and having operating arm means mounted thereon for oscillation therewith, said arm means being operatively associated with said bar for reciprocating the latter in response to oscillation of said doorknob assembly, said doorknob assembly including a sleeve assembly extending through said housing and having door inner and outer knobs mounted on its opposited ends, said inner knob being secured on said sleeve assembly by means of a through bolt extending through said sleeve assembly and threadedly engaged with said outer knob, said sleeve assembly including opposite end sleeve sections journaled through opposing walls of said housing, said operating arm being carried by a connecting sleeve member into whose opposite ends the adjacent ends of said sleeve sections are telescoped, said operating arm being rotatably mounted on said connecting sleeve and said connecting sleeve and operating arm including coacting slip clutch means connecting said operating arm to said connecting sleeve for oscillation therewith.

2. The combination of claim 1 wherein said sleeve sections have substantially parallel spaced apart adjacent end faces, said connecting sleeve including radially inwardly projecting pin means captive between said end faces.

3. The combination of claim 1 wherein said inner knob includes a central cosmetic screw threaded therein axially aligned and engaged with the corresponding outer end of said through bolt as a jam member therefor.

4. The combination of claim 1 wherein said lock means includes a shaft oscillatably journaled in said housing, said lock means being mounted on said shaft for oscillation therewith, said shaft including first and second oppositely outwardly directed arm portions, said operator means including selectively operable first and second abutment member shiftably supported from said housing and engageable with said first and second arm portions, said first and second abutment members including solenoid actuated abutment members, said shaft including a second pair of oppositely outwardly directed arm portions, said operator means further including a pair of push buttons engageable with said second pair of arm portions and operable from the exterior of one side of said housing.

5. The combination of claim 1 wherein said lock includes a latch bar supported from said housing for longitudinal reciprocation between limit positions with one end extended and retracted relative to said housing, said lock means including a lock actuator member supported from said housing for shifting between active and inactive position and including portions thereof movable into and out of position for locking engagement with said bars to prevent their movement from extended positions toward retracted positions, and domestic current operable first and second solenoid means operatively associated with said lock actuator member for shifting the latter toward said active and inactive positions and third battery actuatable solenoid means operatively associated with said lock actuator member for shifting the latter toward said inactive position.

6. The combination of claim 5 wherein said lock means includes spring detent means operatively associated with said lock actuator member for frictionally retaining the latter in predetermined relatively shifted positions.

7. The combination of claim 5 wherein said lock actuater member includes means operatively associated with said lock bar to prevent movement of said lock bar from its retracted position toward its extended position while said latch bar remains free to shift between its extended and retracted positions.

* * * * *